US010173440B2

(12) United States Patent
Nakano et al.

(10) Patent No.: US 10,173,440 B2
(45) Date of Patent: Jan. 8, 2019

(54) PRINTING APPARATUS

(71) Applicant: SEIKO EPSON CORPORATION, Tokyo (JP)

(72) Inventors: Shuichiro Nakano, Matsumoto (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/046,637

(22) Filed: Feb. 18, 2016

(65) Prior Publication Data

US 2016/0243853 A1 Aug. 25, 2016

(30) Foreign Application Priority Data

Feb. 24, 2015 (JP) ..... 2015-034403

(51) Int. Cl.
*B41J 15/00* (2006.01)
*B41J 11/00* (2006.01)

(52) U.S. Cl.
CPC ..... *B41J 11/002* (2013.01)

(58) Field of Classification Search
CPC combination set(s) only.
See application file for complete search history.

(56) References Cited

U.S. PATENT DOCUMENTS 3,720,002 A * 3/1973 Martin ..... D06C 7/00 34/421
3,999,306 A * 12/1976 Koch, II ..... F26B 23/02 34/216
4,287,671 A * 9/1981 Koch, II ..... B05D 3/02 34/446
4,365,423 A * 12/1982 Arter ..... F26B 13/10 118/58
4,434,562 A * 3/1984 Bubley ..... B41F 23/0409 101/424.1
4,646,446 A * 3/1987 Bubley ..... F26B 3/283 34/278
4,994,642 A * 2/1991 Matsumoto ..... G03B 27/32 219/216
4,999,927 A * 3/1991 Durst ..... F26B 13/10 34/448
5,317,127 A * 5/1994 Brewster, Jr. ..... F26B 3/283 219/388

(Continued)

FOREIGN PATENT DOCUMENTS

JP 2001-071473 A 3/2001
JP 2001-108370 A 4/2001

(Continued)

*Primary Examiner* — Matthew Luu
*Assistant Examiner* — Lily Kemathe
(74) *Attorney, Agent, or Firm* — Workman Nydegger

(57) ABSTRACT

A printing apparatus includes a printing section that performs printing by adhering an ink to a medium, a transport section that transports the medium, and a heating device that heats the medium, on which printing is finished. The heating device includes a first partitioning wall that has an infrared ray emission surface that faces a third support member via a heating region, and a heating section which heats the first partitioning wall, and an area of the infrared ray emission surface is greater than a projection area obtained by projecting the infrared ray emission surface toward the third support member.

4 Claims, 5 Drawing Sheets

(56) References Cited

U.S. PATENT DOCUMENTS 5,621,983 A * 4/1997 Lundemann ..... F26B 13/10 34/460
6,354,015 B1 * 3/2002 Ogasawara ..... F26B 3/283 34/60
6,439,712 B1 * 8/2002 Mizutani ..... B41J 2/01 219/216
6,448,993 B1 * 9/2002 Hayashi ..... B41J 2/3353 347/203
6,469,724 B1 * 10/2002 Hayashi ..... B41J 2/33525 347/203
7,381,931 B2 * 6/2008 Hayashi ..... F26B 13/10 219/552
7,477,277 B2 * 1/2009 Sasaki ..... B41J 2/335 165/185
7,541,560 B2 * 6/2009 Hayashi ..... F26B 13/10 100/153
8,113,634 B2 * 2/2012 Mizoguchi ..... B41J 2/1609 347/40
8,888,260 B2 * 11/2014 Hayashi ..... B41J 2/17563 347/93
9,010,920 B2 * 4/2015 Nishimura ..... B41J 11/002 347/102
9,022,510 B2 * 5/2015 Sasaki ..... B41J 11/002 347/16
9,114,639 B2 * 8/2015 Sasaki ..... B41J 11/002
9,302,502 B2 * 4/2016 Sasaki ..... B41J 11/0015
9,352,571 B2 * 5/2016 Sasaki ..... B41J 2/1714
2002/0146259 A1 * 10/2002 Zhou ..... C25D 1/04 399/329
2005/0040157 A1 * 2/2005 Hayashi ..... F26B 13/18 219/469
2005/0100373 A1 * 5/2005 Kishino ..... G03G 15/2057 399/329
2006/0132586 A1 * 6/2006 Sasaki ..... B41J 2/335 347/223
2010/0110156 A1 * 5/2010 Hara ..... B41J 2/155 347/102
2010/0141725 A1 * 6/2010 Shiohara ..... B41J 11/0015 347/102
2010/0180784 A1 * 7/2010 Shiohara ..... B41J 11/002 101/424.1
2010/0188455 A1 * 7/2010 Shinkawa ..... B41J 2/155 347/16
2010/0188469 A1 * 7/2010 Ikegami ..... B41J 3/543 347/102
2011/0261102 A1 * 10/2011 Kurasawa ..... B41J 11/002 347/16
2012/0249703 A1 * 10/2012 Nishimura ..... B41J 11/002 347/102
2013/0242018 A1 * 9/2013 Shiohara ..... B41J 11/0015 347/102
2014/0205959 A1 * 7/2014 Naramatsu ..... B41J 11/002 432/253
2014/0320564 A1 * 10/2014 Sasaki ..... B41J 11/002 347/17
2015/0029278 A1 * 1/2015 Sasaki ..... B41J 11/002 347/102
2015/0103117 A1 * 4/2015 Sasaki ..... B41J 2/1714 347/25
2015/0138269 A1 * 5/2015 Sasaki ..... B41J 11/0095 347/19
2015/0251450 A1 * 9/2015 Hasebe ..... B41J 11/002 347/102
2016/0159111 A1 * 6/2016 Sasaki ..... B41J 11/0015 347/102

FOREIGN PATENT DOCUMENTS

JP 2013-028095 A 2/2013
JP 2014-156939 A 8/2014
JP 2015-066519 A 4/2015

* cited by examiner 100
110
115
111
116
113
112
160
130
131
132
120
140
150
151
200
220
221
240
210
211
230
231
251
252
253
70
71
72
73
74
75
76
77
80
HA
D
F
Z
Y

PRINTING APPARATUS

BACKGROUND

1. Technical Field

The present invention relates to a printing apparatus such as an ink jet type printer.

2. Related Art

In the related art, as an example of a printing apparatus, an ink jet type printer that forms characters and images by ejecting an ink as an example of a liquid onto a medium such as a sheet of paper, is known. Among such printers, there are printers that are provided with a heating device, which includes a fan that blows a gas toward a medium, and a heater that heats the gas that the fan blows, and emits infrared rays onto a medium onto which ink is injected (for example, JP-A-2013-28095).

Further, in such a printer, a solvent component (for example, water) in an ink that is ejected onto a medium, is caused to evaporate by heating the medium as a result of heat transfer due to a heated gas (hot air), and thermal radiation due to the heater.

However, in a printer that is provided with a heating device such as that mentioned above, there is still room for improvement in a feature of enhancing the heating efficiency of a heating device when drying a medium onto which ink has been ejected.

In addition, the abovementioned circumstances are not limited to ink jet printers, and are generally the same in printing apparatuses that enhance a fixing property of an ink to a medium, to which ink is adhered, by heating the medium.

SUMMARY

An advantage of some aspects of the invention is to provide a printing apparatus that is capable of enhancing the heating efficiency of a medium.

Hereinafter, means of the invention and operation effects thereof will be described.

According to an aspect of the invention, there is provided a printing apparatus including a printing section that performs printing by adhering an ink to a medium, a transport section that transports the medium along a transport path of the medium, and a heating device that heats the medium, on which printing is finished, in which, when a region between the transport path and the heating device is set as a heating region, the heating device includes an infrared ray emission section which has an infrared ray emission surface that faces the transport path via the heating region, and a heating section which heats the infrared ray emission section, and an area of the infrared ray emission surface is greater than a projection area obtained by projecting the infrared ray emission surface toward the transport path.

In this case, as a result of the heating section heating the infrared ray emission section, the infrared ray emission section is heated and infrared rays are emitted from the infrared ray emission surface of the infrared ray emission section toward the medium that is positioned in the heating region. In this manner, it is possible to heat the medium using thermal radiation. In this instance, the area of the infrared ray emission surface is greater than a projection area obtained by projecting the infrared ray emission surface toward the transport path. Therefore, it is possible to increase an infrared ray emission amount with respect to the medium by an amount by which the area over which it is possible to emit infrared rays with respect to the medium is greater. In this manner, it is possible to enhance the heating efficiency of the medium.

In the printing apparatus, it is desirable that, when the infrared ray emission section is set as a first partitioning wall, the heating device includes a heating chamber, at least a part of which is partitioned by the first partitioning wall and a second partitioning wall, through which an inlet is formed penetrating therethrough, and a gas inflow section that causes a gas to flow into the heating chamber via the inlet, the heating section heats the heating chamber, and an outlet, which is open toward the heating region, is formed penetrating through the first partitioning wall.

In this case, the gas inside the heating chamber is heated as a result of the heating section heating the heating chamber. Further, the heated gas is heated is blown against the medium that is positioned in the heating region as a result of causing the heated gas to flow out from the heating chamber via the outlet, which is open to the infrared ray emission surface. In this manner, it is possible to heat the medium using heat transfer.

In addition, since the first partitioning wall (the infrared ray emission section) partitions the heating chamber, it is possible to heat the gas that flows out from the heating chamber via the outlet, and to heat the first partitioning wall as a result of the heating section heating the heating chamber. In this manner, it is possible to heat the medium using heat transfer and thermal radiation with a simple configuration.

In the printing apparatus, it is desirable that a plurality of the flow outlets are formed penetrating through the first partitioning wall in different directions.

In this case, since outflow directions of the gas, which is caused to flow out from the heating chamber via the outlets, differ, it is easy for the gas, which is caused to flow out, to mix together in the heating region. Therefore, even in a case in which there are variations in the temperatures of the gas that is caused to flow out from the different outlets, it is possible to suppress variations in the temperature distribution in the heating region.

It is desirable that the printing apparatus further includes a support member that supports the medium, configures at least a part of the transport path, and is provided to face the heating device via the heating region, the first partitioning wall includes an intersecting wall that extends in a direction that intersects the medium supported on the support member, and the outlet is formed penetrating through the intersecting wall in a thickness direction thereof.

In this case, since the medium that is supported on the support member and the intersecting wall intersect, and the outlet is formed penetrating through the intersecting wall in the thickness direction thereof, the medium that is supported on the support member and a penetration direction of the outlet with respect to the intersecting wall intersect with one another at an angle of less than 90°. Therefore, the gas that is caused to flow out from the heating chamber via the outlet is blown against the medium that is supported on the support member in a non-orthogonal manner. Accordingly, a force with which the medium is pushed against a support surface is reduced, and therefore, it is possible to reduce a transport load when transporting the medium.

In the printing apparatus, it is desirable that the gas inflow section causes a gas that is taken in from the heating region to flow into the heating chamber.

In this case, it is possible to cause a heated gas that is caused to flow out to the heating region, to flow into the heating chamber again. Therefore, it is more difficult for the temperatures of the heating chamber and the heating region to fall than a case in which an unheated gas from a region that is not the heating region is caused to flow into the heating chamber, and therefore, it is possible to further enhance the heating efficiency of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the drawings. Additionally, a printing apparatus of the present embodiment is an ink jet type large format printer that forms characters and images by ejecting an ink, as an example of a liquid, onto a medium such as longitudinal sheets of paper.

Figure 1:
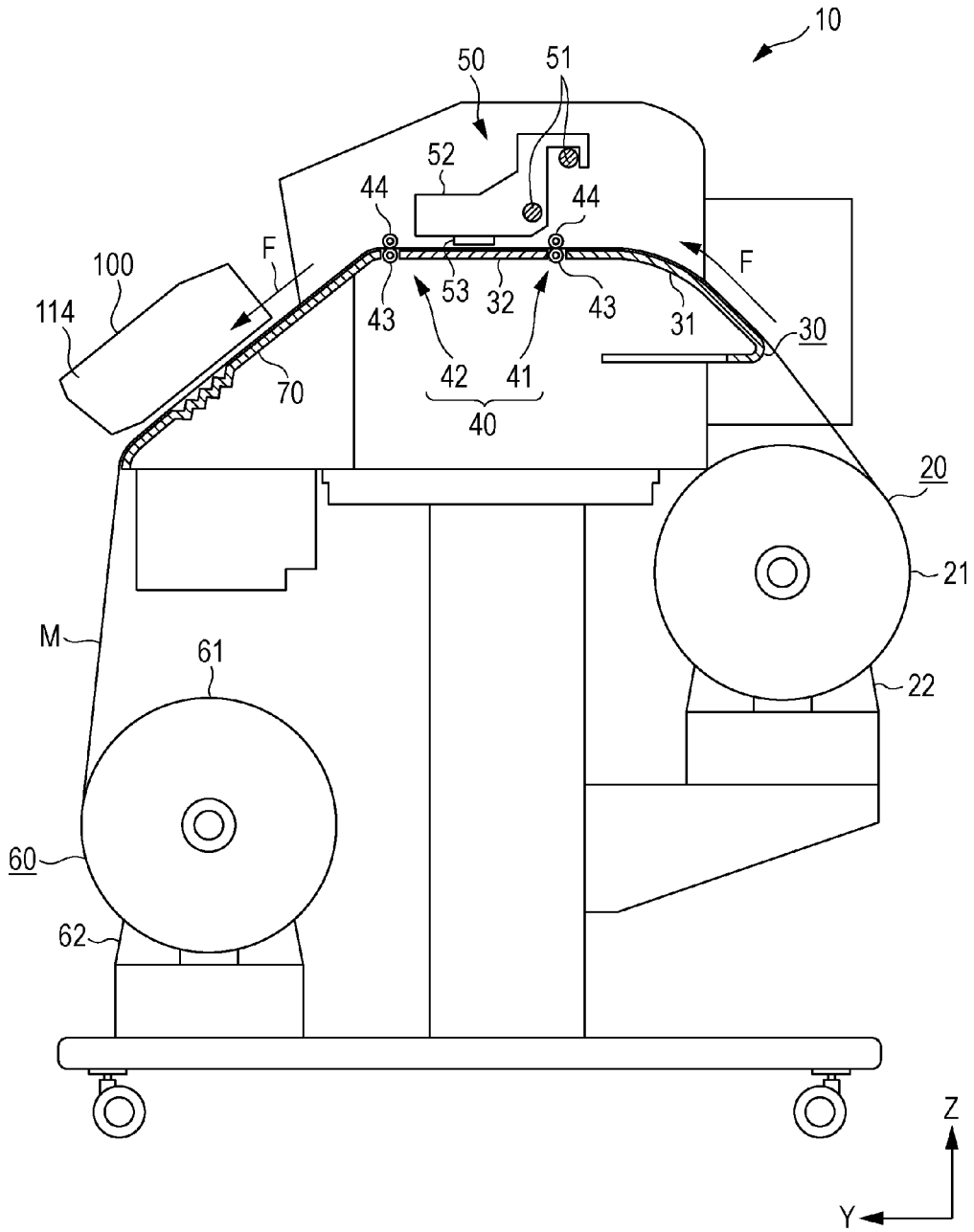
FIG. 1 is a side view that shows a schematic configuration of a printing apparatus.

As shown in FIG. 1, a printing apparatus 10 is provided with a delivery section 20 that delivers a medium M, which is wound up in roll form, along a movement direction of the medium M, a support section 30 that supports the medium M, a transport section 40 that transports the medium M, a printing section 50 that performs printing on the medium M, a heating device 100 that heats the medium M, and a winding section 60 that winds the medium M.

Additionally, in the following description, a direction that is orthogonal to a paper surface in FIG. 1 will be referred to as a width direction X (refer to FIG. 2), a left-right direction in FIG. 1 will be referred to as a front-back direction Y, and an up-down direction in FIG. 1 will be referred to as a vertical direction Z. Additionally, the width direction X, the front-back direction Y, and the vertical direction Z are directions that intersect (are orthogonal to) one another.

In addition, in the printing apparatus 10, a movement direction of the medium M from the delivery section 20 to the winding section 60 is set as a transport direction F. Therefore, for example, it can be said that the delivery section 20 is provided on a furthest upstream side in the transport direction F, and it can be said that the winding section 60 is provided on a furthest downstream side in the transport direction F. In addition, in the following description, a direction that runs downstream in the transport direction F will simply be referred to as the transport direction F.

The delivery section 20 includes a holding section 22 that holds a roll body 21, around which the medium M is wound up in roll form. Further, the delivery section 20 performs delivery of the rolled medium M that is unrolled from the roll body 21 by rotating the roll body 21 in a first direction (the anticlockwise direction in FIG. 1).

The support section 30 is provided with a first support member 31, a second support member 32 and a third support member 70 along the transport direction F. The first support member 31, the second support member 32 and the third support member 70 form plate forms in which the width direction X is set as a longitudinal direction, and support the medium M by coming into contact with corresponding medium M across the width direction X.

To explain in further detail, the first support member 31 supports the medium M before printing that is transported from the delivery section 20 to the second support member 32. The second support member 32 is provided in a region that faces the printing section 50, supports the medium M on which printing is performed. The third support member 70 is provided in a region that faces the heating device 100, and supports the medium M, on which printing is finished, that is transported from the second support member 32 toward the winding section 60.

In addition, in the present embodiment, as shown in FIG. 1, the first support member 31, the second support member 32 and the third support member 70 configure a part of a "transport path" of the medium M. In addition, a path in which the medium M, which is delivered from the delivery section 20, moves supported by the first support member 31, and a path in which the medium, which is supported by the third support member 70, moves to being wound in the winding section 60 are equivalent to a part of the transport path of the medium M.

The transport section 40 is provided with first transport rollers 41 that are disposed between the first support member 31 and the second support member 32 in the transport direction F, and a second transport rollers 42 that are disposed between the second support member 32 and the third support member 70 in the transport direction F.

The first transport rollers 41 and the second transport rollers 42 include driving rollers 43 that apply a transport force to the medium M by rotating in a state of coming into contact with the medium M, and driven rollers 44 that are driven to rotate as a result of coming into contact with the medium M that is transported. Further, the transport section 40 transports the medium M toward the downstream side in the transport direction by driving the driving rollers 43 in a state in which the medium M is interposed and supported between the first transport rollers 41 and the second transport rollers 42.

The printing section 50 is provided with guide shafts 51 that intersect the transport direction F with the width direction X set as the longitudinal direction thereof, a carriage 52 that is supported by the guide shafts 51, and a printing head 53 that ejects the ink onto the medium M from nozzles, which are not illustrated in the drawings. The carriage 52 reciprocates in the longitudinal direction of the guide shafts 51, which is the width direction X, as a result of the driving of a carriage motor, which is not illustrated in the drawings. The printing head 53 is supported vertically below the carriage 52.

Further, the printing section 50 performs a printing action, which forms characters or images on the medium M, by ejecting the ink at a timing that is suitable for the printing head 53 during movement of the carriage 52 in the width direction X. Additionally, in the present embodiment, the ink that is ejected from the printing head 53, includes a color material that is formed from a dye or a pigment, as a solute, and is a water-based ink, in which the main solvent is water.

In addition, in the following description, a target printing surface of the medium M to be printed on by the printing section 50, may be referred to as a "front surface of the medium M", and a target support surface of the medium M to be supported by the support section 30, may be referred to as a "rear surface of the medium M". Additionally, in the present embodiment, the front surface of the medium M is equivalent to a "second surface of the medium M", and the rear surface of the medium M is equivalent to a "first surface of the medium M".

The winding section 60 includes a holding section 62 that holds a roll body 61, around which the medium M is wound up in roll form. Further, the winding section 60 performs winding of the rolled medium M, on which printing is finished, by rotating the roll body 61 in a first direction (the anticlockwise direction in FIG. 1).

Next, the heating device 100 will be described in detail with reference to FIGS. 2 to 4C.

Figure 2:
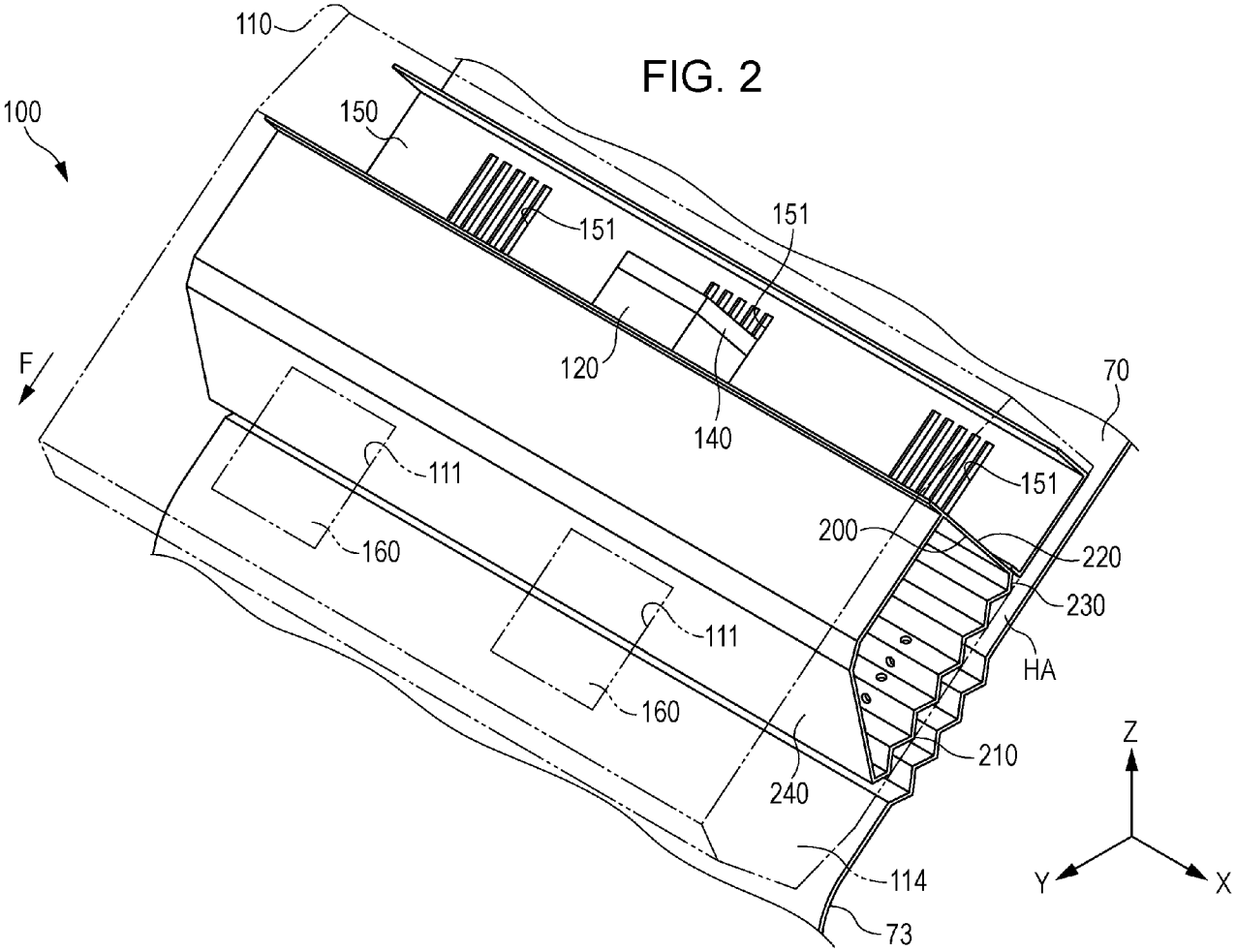
FIG. 2 is a perspective view that shows a schematic configuration of a heating device and a third support member.
Figure 3:
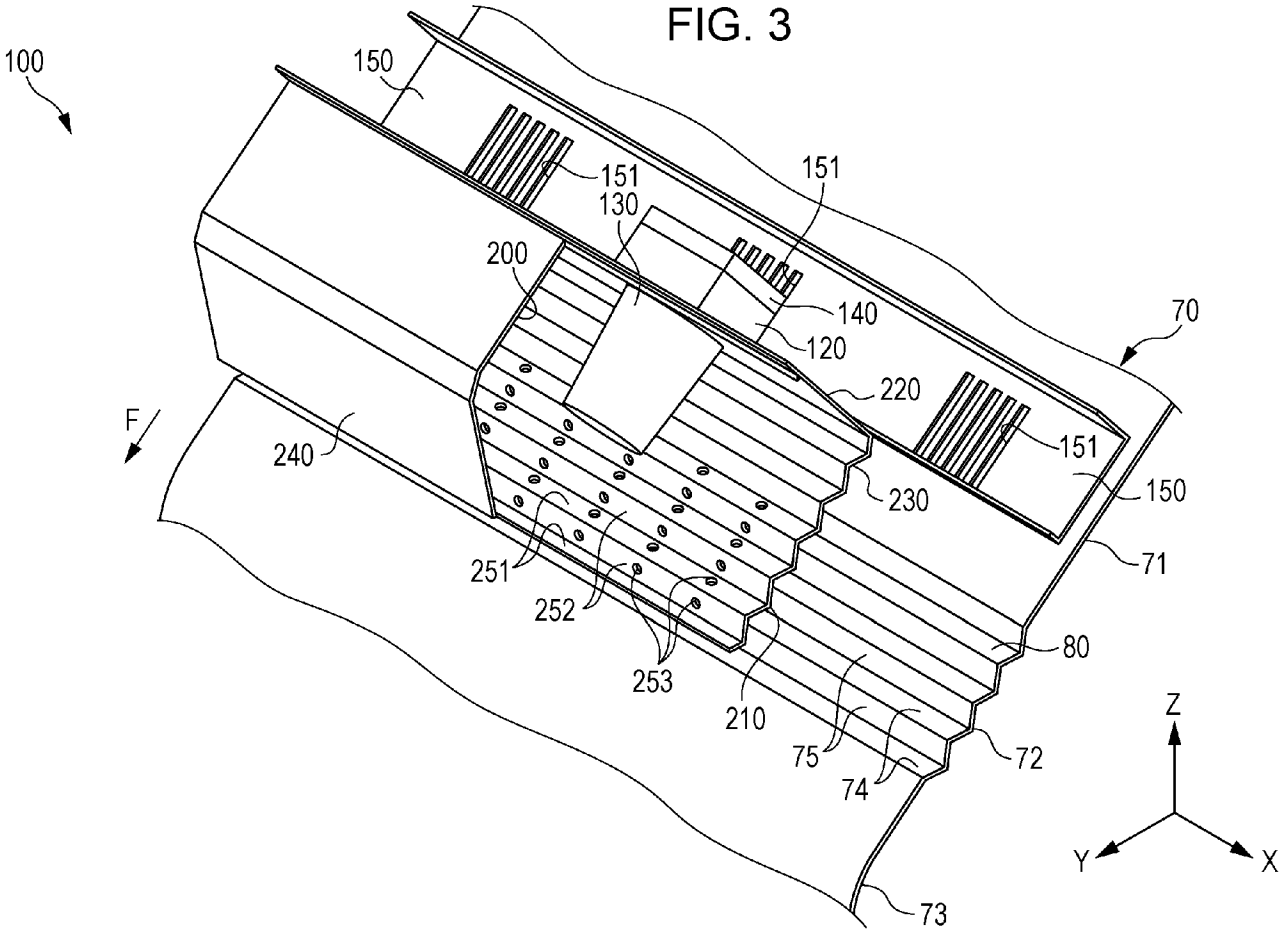
FIG. 3 is a perspective view that shows a schematic configuration of the heating device and the third support member in which a part of the configuration is ruptured.

As shown in FIGS. 2 and 3, the heating device 100 is provided with a case 110 that forms the exterior of the corresponding heating device 100, a heating chamber 200 that forms a closed space, a first fan 120 that blows a gas (for example, air) into an inner section of the heating chamber 200, a heating section 130 that heats the gas, which the first fan 120 blows, and a moisture absorption section 140 that dehumidifies the gas, which the first fan 120 blows. In addition, the heating device 100 is provided with a support plate 150 that supports the first fan 120, and a second fan 160 that blows a gas into an inner section of the case 110.

Additionally, since the heating device 100 heats the medium M that is supported by the third support member 70, it is desirable that the length in the width direction X of the heating device 100 is greater than or equal to the length in the width direction X of the medium M that is set as a printing target of the printing apparatus 10. In addition, in the following description, a region for heating the medium M, which is a region between the heating device 100 and the third support member 70, will be referred to as a "heating region HA".

Figures 4A, 4B, 4C:
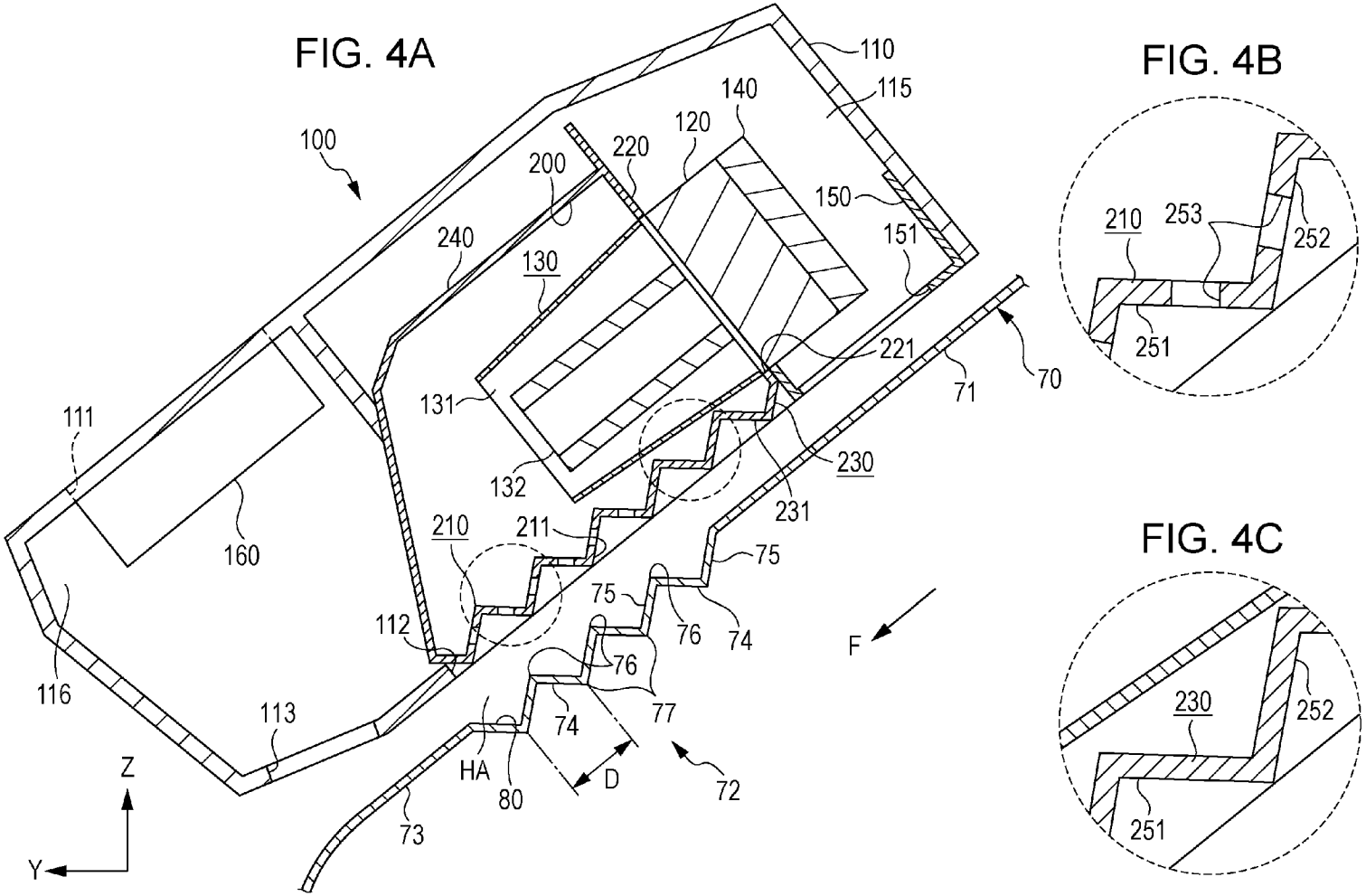
FIG. 4A is a cross-sectional view of the heating device and the third support member in a width direction.
FIG. 4B is an enlarged cross-sectional view of a first partitioning wall.
FIG. 4C is an enlarged cross-sectional view of a third partitioning wall.

As shown in FIGS. 2 and 4A, a plurality of (two) attachment openings 111 are opened at an interval in the width direction X on a side of the case 110 that is opposite to a third support member 70 side. In addition, as shown in FIG. 4A, an accommodation opening 112, and an air-blow opening 113 are opened lined up in the transport direction F on the third support member 70 side of the case 110 so as to face the third support member 70.

As shown in FIG. 2, the heating chamber 200 is partitioned in the width direction X by a side wall 114 of the case 110. In addition, as shown in FIGS. 3 and 4A, the heating chamber 200 is partitioned in directions that intersect the width direction X by a first partitioning wall 210, a second partitioning wall 220, a third partitioning wall 230 and a fourth partitioning wall 240.

As shown in FIGS. 3 and 4A to 4C, the first partitioning wall 210 and the third partitioning wall 230 are provided so as to face the third support member 70. In this instance, the first partitioning wall 210 is integrally continuous with the third partitioning wall 230 in a manner in which the first partitioning wall 210 is positioned further on a downstream side in the transport direction F than the third partitioning wall 230. In addition, the first partitioning wall 210 and the third partitioning wall 230 include first intersecting walls 251 and second intersecting walls 252 that intersect the medium M (the transport path) that is supported by the third support member 70.

In the cross-sectional views that are shown in FIGS. 4B and 4C, the first intersecting walls 251 are provided so as to run along the inner section the heating chamber 200 running along the transport direction F, and the second intersecting walls 252 are provided so as to run along an outer section of the heating chamber 200 running along the transport direction F. In this manner, the first partitioning wall 210 and the third partitioning wall 230 alternately zigzag on an inner side and an outer side of the heating chamber 200 in the corresponding transport direction F as a result of being configured by alternately disposing the first intersecting walls 251 and the second intersecting walls 252 in the transport direction F.

Accordingly, a surface area of the first partitioning wall 210 that faces the third support member 70 is greater than a projection area obtained by projecting the first partitioning wall 210 toward the third support member 70, and a surface area of the third partitioning wall 230 that faces the third support member 70 is greater than a projection area obtained by projecting the third partitioning wall 230 toward the third support member 70. Additionally, a direction of the projection of the first partitioning wall 210 and the third partitioning wall 230 that is referred to in this instance is a direction that is, for example, orthogonal to the third support member 70 (the transport path).

In addition, as shown in FIGS. 3 and 4B, outlets 253 are formed penetrating through the first intersecting walls 251 and the second intersecting walls 252 of the first partitioning wall 210 in thickness directions thereof. As shown in FIG. 3, the outlets 253 are formed in a plurality at intervals in the longitudinal directions (the width direction X) of the first intersecting walls 251 and the second intersecting walls 252. In this manner, a plurality of outlets 253 is formed penetrating through in the first partitioning wall 210 at intervals in the transport direction F and the width direction X. Additionally, as shown in FIGS. 4A and 4B, one side of the outlets 253 is open to the heating chamber 200, and the other side thereof is open to the heating region HA.

In addition, as shown in FIG. 4B, the first intersecting walls 251 and the second intersecting walls 252 of the first partitioning wall 210 are provided so as to mutually intersect in a cross-sectional view in the width direction X. Therefore, a penetration direction of the outlets 253 in the first intersecting walls 251, and a penetration direction of the outlets 253 in the second intersecting walls 252 are different directions.

On the other hand, as shown in FIG. 4C, unlike the first intersecting walls 251 and the second intersecting walls 252 of the first partitioning wall 210, the outlets 253 are not formed penetrating through the first intersecting walls 251 and the second intersecting walls 252 of the third partitioning wall 230.

In addition, in the present embodiment, the first partitioning wall 210 and the third partitioning wall 230 are equivalent to the "infrared ray emission section" that heats the medium M using thermal radiation by emitting infrared rays toward the corresponding medium M that is supported on the third support member 70, and among the first partitioning wall 210 and the third partitioning wall 230, the surfaces that are on the third support member 70 side are equivalent to infrared ray emission surfaces 211 and 231 that emit the infrared rays. Therefore, it is desirable that the first partitioning wall 210 and the third partitioning wall 230 are formed using a material that can efficiently heat the medium M using thermal radiation.

In this instance, the infrared ray emission amount (an emission energy) from the first partitioning wall 210 and the third partitioning wall 230 is proportionate to the fourth power of the temperatures of the infrared ray emission surfaces 211 and 231 of the first partitioning wall 210 and the third partitioning wall 230. Accordingly, in order to increase the infrared ray emission amount from the first partitioning wall 210 and the third partitioning wall 230, it is desirable that a heat transfer rate of the first partitioning wall 210 and the third partitioning wall 230 is high in order to increase the temperatures of the infrared ray emission surfaces 211 and 231 of the first partitioning wall 210 and the third partitioning wall 230 at an early stage.

In addition, in order to increase the infrared ray emission amount from the first partitioning wall 210 and the third partitioning wall 230, it is desirable that an emission rate of the infrared ray emission surfaces 211 and 231 of the first partitioning wall 210 and the third partitioning wall 230 is high. To explain in more detail, it is desirable that the emission rates in the intermediate infrared ray region and the far infrared ray region, which are the infrared ray absorption wavelength regions of the ink, are high (greater than or equal to 0.8). Additionally, in the present specification, electromagnetic waves with a wavelength of approximately 0.7 μm to approximately 2.5 μm are set as near infrared rays, electromagnetic waves with a wavelength of approximately 2.5 μm to approximately 4 μm are set as intermediate infrared rays, and electromagnetic waves with a wavelength of approximately 4 μm to approximately 1000 μm are set as far infrared rays.

Accordingly, it is desirable that the first partitioning wall 210 and the third partitioning wall 230 are configured using aluminum or an aluminum alloy, in which the heat transfer rates are comparatively high, and that an alumite process is carried out on the infrared ray emission surfaces 211 and 231 in order to enhance the emission rates thereof. Furthermore, it is desirable that the first partitioning wall 210 and the third partitioning wall 230 are configured using a Super Ray (Registered Trademark), which is a far infrared ray high emission aluminum functional material.

More specifically, it is desirable that the first partitioning wall 210 and the third partitioning wall 230 are configured from an aluminum alloy, which contains 0.3 wt % to 4.3 wt % of Mn (manganese), in which the remainder is formed from Al (aluminum) and unavoidable impurities, and in which the Mn and Al intermetallic compound is dispersed and precipitated, and an alumite layer that is formed on the surface of the abovementioned compound. In addition, such a material may contain 0.05 wt % to 6 wt % of Mg (magnesium). Additionally, for example, such a material is disclosed in JP-A-4-110493.

Incidentally, as a result of such a material, an improvement in the emission rate is due to the facts that the reflectance of an aluminum alloy surface on which an aluminum process has been performed, is reduced, and minute uneven sections are formed as a result of the corresponding surface having a porous structure, and therefore, the surface area thereof is increased.

As shown in FIGS. 3 and 4A, the second partitioning wall 220 extends in a direction that intersects (is orthogonal to) the transport direction F in a manner that intersects the third partitioning wall 230. As shown in FIG. 4A, an inlet 221 is formed penetrating through the second partitioning wall 220 in the substantial center thereof in the width direction X. In addition, as shown in FIGS. 3 and 4A, the fourth partitioning wall 240 is continuous with the first partitioning wall 210 and the second partitioning wall 220.

Additionally, in the present embodiment, the first partitioning wall 210, the second partitioning wall 220, the third partitioning wall 230 and the fourth partitioning wall 240 may be formed integrally as a result of performing extrusion molding toward the width direction X, or may be welded or fastened together using a fastening member after forming the respective partitioning walls separately.

As shown in FIG. 4A, the first fan 120 is provided on an inner side of the case 110, and on the outer side of the heating chamber 200 in a manner that closes the inlet 221 of the second partitioning wall 220. Further, the first fan 120 blows a gas from the outer section of the heating chamber 200 into the inner section of the heating chamber 200 via the inlet 221. In this respect, in the present embodiment, the first fan 120 is equivalent to a "gas inflow section" that causes a gas to flow into the heating chamber 200 via the inlet 221. Additionally, the first fan 120 may, for example, be an axial flow fan, or may be a centrifugal fan.

As shown in FIG. 4A, the heating section 130 includes a cylindrical section 131 that forms a cylindrical shape, and a heat-generating element 132 that generates heat as a result of a current flowing therein. With respect to the cylindrical section 131, while a base end side is in communication with the inlet 221 of the second partitioning wall 220, a tip end side thereof is open to the inner section of the heating chamber 200. In addition, the heat-generating element 132 is accommodated on the inner side of the cylindrical section 131.

In this manner, the heating section 130 heats the gas, which flows in from the inlet 221, by causing the gas to flow through an inner side of the cylindrical section 131, which accommodates the heat-generating element 132. In addition, the heating chamber 200 and the first partitioning wall 210, the second partitioning wall 220, the third partitioning wall 230 and the fourth partitioning wall 240, which partition the corresponding heating chamber 200, are heated as a result of the gas, which flows into the heating chamber 200, being heated.

Additionally, it is desirable that the driving of the first fan 120 and the heating section 130 is, for example, controlled in the following manner. That is, a temperature sensor, which measures the temperature of the heating region HA may be provided in the corresponding heating region HA, and the first fan 120 and the heating section 130 may be controlled depending on a difference between a practical temperature in the heating region HA and a target temperature. Additionally, the target temperature that is referred to in this instance is a temperature that forms a target for the degrees that it is desirable to set the temperature of the heating region HA to, and it is desirable that the target temperature is determined as appropriate depending on the type of the medium M and the type of the ink.

As shown in FIG. 4A, the moisture absorption section 140 is attached to the first fan 120, and removes moisture, which is included in the gas that the first fan 120 takes in. Additionally, a moisture absorption method of the moisture absorption section 140 may, for example, be an adsorption method that performs moisture absorption by causing the gas, which the first fan 120 takes in, to pass through a solid body that adsorbs the solvent component (for example, water) of the ink easily. In addition, the moisture absorption method may be an absorption method that performs moisture absorption by causing the gas, which the first fan 120 takes in, to come into contact with a liquid body that absorbs the solvent component of the ink easily. In this respect, in the present embodiment, the moisture absorption section 140 is equivalent to an example of a "capture section" that captures solvent vapor (for example, water vapor) of the ink that is included in the gas that the first fan 120 takes in.

As shown in FIG. 3, with respect to the support plate 150, the width direction X is set as a longitudinal direction thereof, and a cross-sectional shape thereof, which intersects the width direction X, forms a substantial C-shape. A plurality of (three in the present embodiment) intake openings 151, through which the gas passes, are formed penetrating through the support plate 150. In addition, the intake openings 151 are open toward the third support member 70 via the heating region HA.

In addition, the support plate 150 is provided still further on an upstream side in the transport direction than the third partitioning wall 230, which is provided further on the upstream side in the transport direction than the first partitioning wall 210. Therefore, in the heating region HA, a region between the third partitioning wall 230 and the third support member 70 is positioned between a region between the first partitioning wall 210 and the third support member 70 and a region between the support plate 150 and the third support member 70.

In addition, as shown in FIG. 4A, the heating chamber 200 and the support plate 150 partition the inner section of the case 110 into a first space 115 on an upstream side in the transport direction, and a second space 116 on the downstream side in the transport direction. That is, in the present embodiment, three closed space, including the heating chamber 200, are formed in the inner section of the case 110.

In this instance, the first space 115 is a space in which the first fan 120 and the moisture absorption section 140 are accommodated, and is a space that is in communication with the heating region HA via the intake openings 151 of the support plate 150. Accordingly, in a case in which the first fan 120 blows a gas into the heating chamber 200, it is possible to take the corresponding gas in from the heating region HA via the first space 115. Meanwhile, the second space 116 is a space in which the second fan 160 is accommodated, and is a space that is in communication with the heating region HA via the air-blow openings 113.

As shown in FIG. 4A, the second fan 160 is attached to the attachment opening 111. The second fan 160 blows a gas from the second space 116 to the downstream side of the heating region HA in the transport direction via the air-blow opening 113 by blowing air that is external to the heating device 100 into the corresponding second space 116. In this manner, the second fan 160 cools the medium M by blowing the external air against the medium M that is heated by the heating device 100 via the air-blow opening 113. Additionally, the second fan 160 may, in the same manner as the first fan 120, for example, be an axial flow fan, or may be a centrifugal fan.

As shown in FIG. 1, the third support member 70 is formed so as to run along in a vertically downward manner running along the transport direction F. In addition, the third support member 70 is provided so as to face the heating device 100. Further, the third support member 70 supports the medium M, on which printing is finished, by coming into contact with the corresponding medium M from a rear surface side.

In addition, as shown in FIGS. 3 and 4A, the third support member 70 includes a flat surface section 71, which forms a flat plate shape in the transport direction F, a zig-zag section 72, which forms a zig-zag shape in the transport direction F, and a curved section 73, which forms a curved plate shape in the transport direction F. The flat surface section 71, the zig-zag section 72 and the curved section 73 are provided so as to line up toward the downstream side in the transport direction. That is, as shown in FIG. 4A, the flat surface section 71 faces the third partitioning wall 230 and the support plate 150 of the heating device 100, the zig-zag section 72 faces the first partitioning wall 210 of the heating device 100, and the curved section 73 faces a formation site of the air-blow opening 113 in the case 110 of the heating device 100.

In addition, it is desirable that the material that configures the third support member 70 is a material in which the heat transfer rate is low. The reason for this is that the third support member 70 draws heat from the medium M when the corresponding medium M is heated in a state in which the third support member 70 is supporting the medium M. In addition, the third support member 70 includes an infrared ray reflective surface 80, which faces the heating device 100 via the heating region HA. In this instance, it is desirable that the reflectance of the infrared ray reflective surface 80 is high (greater than or equal to 0.8), and for example, it is desirable that the infrared ray reflective surface 80 is a mirror surface.

As shown in FIG. 4A, the zig-zag section 72 is configured by alternately disposing first intersecting plates 74, which approach the heating device 100 running along the transport direction F, and second intersecting plates 75, which recede from the heating device 100 running along the transport direction F, in the transport direction F. Therefore, in the present embodiment, the first intersecting plates 74 of the zig-zag section 72 correspond to the first intersecting walls 251 of the first partitioning wall 210, and the second intersecting plates 75 of the zig-zag section 72 correspond to the second intersecting walls 252 of the first partitioning wall 210.

In addition, in the present embodiment, as shown in FIG. 4A, sites, which form peaks in a manner that approaches the heating device 100 as a result of the first intersecting plates 74 and the second intersecting plates 75, form contact sections 76, which are capable of coming into contact with the medium M from the rear surface side thereof. On the other hand, sites, which form valleys in a manner that recedes from the heating device 100 as a result of the first intersecting plates 74 and the second intersecting plates 75, form refuge sections 77, which are not capable of coming into contact with the medium M from the rear surface side thereof.

In this manner, the zig-zag section 72 is formed so the contact sections 76 and the refuge sections 77 are alternately repeated in the transport direction F. In other words, in the zig-zag section 72, the contact sections 76 are formed in a plurality at an interval in the transport direction F, and the refuge sections 77 are formed in a plurality at an interval D.

In this instance, in the contact sections 76, a length in the transport direction F that is capable of coming into contact with the medium M is extremely short, and an area over which a single contact section 76 can come into contact with the medium M is extremely small. Additionally, in the present embodiment, the plurality of contact sections 76 come into contact with the medium M from the rear surface side thereof at an interval in the transport direction F, but may come into contact with the medium M from the rear surface side thereof at an interval in the width direction X, or may come into contact with the medium M from the rear surface side thereof at an interval in another direction.

In addition, as long as the contact sections 76 are capable of supporting the medium M by coming into contact with the corresponding medium M from the rear surface side thereof, the contact sections 76 may be another shape. In the same manner, as long as the refuge sections 77 are not capable of coming into contact with the medium M from the right surface side thereof, the refuge sections 77 may be another shape. In addition, in the present embodiment, in the zig-zag section 72, the interval D (=the interval between the contact sections 76) between refuge sections 77 that are adjacent in the transport direction F, is constant, but the corresponding interval D may be changed as appropriate.

Figure 5:
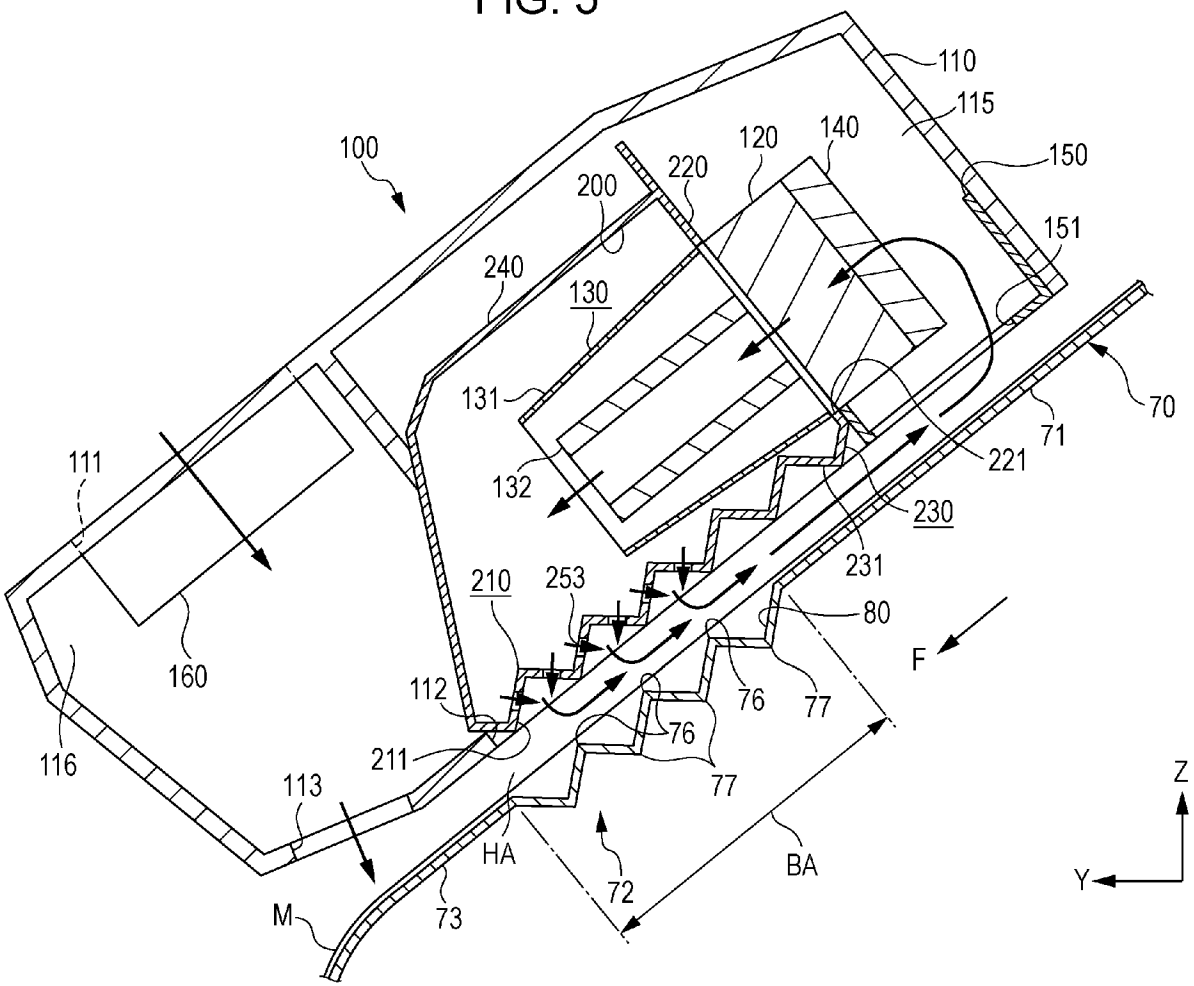
FIG. 5 is a view for describing actions of the printing apparatus, and is a cross-sectional view of the heating device and the third support member in a width direction.

Next, the actions of the printing apparatus 10 will be described with reference to FIG. 5. Additionally, the thick line arrows in FIG. 5 show the flow of a gas in the printing apparatus 10.

In the printing apparatus 10, a case of performing printing on the medium M, the transport section 40 transports the medium M that is delivered from the delivery section 20, to the second support member 32. Further, the printing section 50 forms characters or images on the medium M, which is supported by the second support member 32, by ejecting the ink toward the corresponding medium M.

Subsequently the medium M, on which printing is finished, is transported to the third support member 70 by the transport section 40, and heated by the heating device 100. Additionally, since the printing apparatus 10 of the present embodiment performs printing on a longitudinal medium M, while the ink is ejected onto the medium M, which faces the printing section 50 on the upstream side in the transport direction, the medium M, which faces the printing section 50 is heated (dried) on the downstream side in the transport direction.

Firstly, the actions when the heating device 100 heats the medium M using heat transfer will be described.

Meanwhile, in a case in which the heating device 100 heats the medium M that is supported by the third support member 70, the first fan 120, the second fan 160 and the heating section 130 are driven. That is, the first fan 120 blows a gas into the inside of the heating chamber 200 via the inlet 221, which is formed penetrating through the second partitioning wall 220. In addition, the heating section 130 heats the gas, which is blown into the inside of the heating chamber 200.

When this occurs, the pressure inside the heating chamber 200 becomes higher than the pressure outside the heating chamber 200 as a result of the gas, which is heated inside the heating chamber 200 flowing in, and the temperature inside the heating chamber 200 rises. As a result of this, gas that is heated in the heating chamber 200 (hereinafter, referred to as "hot air") flows out from the heating chamber 200 to the heating region HA via the outlets 253 that are formed penetrating through the first partitioning wall 210.

That is, hot air is blown from the heating chamber 200 toward the medium M that is supported by the third support member 70 via the outlets 253 that are formed penetrating through the first partitioning wall 210. In this manner, the medium M that is supported by the third support member 70 is heated by heat transfer, and a solvent component of the ink that is ejected onto the medium M evaporates.

Further, the hot air that is blown against the medium M rises since the temperature thereof is higher than that of external air, and the density thereof is lower than that of external air. In this instance, since the third support member 70 (the heating region HA) is provided running vertically downward along the transport direction F, the hot air that is blown against the medium M, rises in the heating region HA toward the upstream side in the transport direction.

Meanwhile, in the heating device 100, the support plate 150, in which the intake openings 151, which are in communication with the first space 115, are formed penetrating therethrough, is provided on the upstream side in the transport direction of the first partitioning wall 210, in which the outlets 253 are formed penetrating therethrough. In addition, the first fan 120, which blows gas of the first space 115 into the heating chamber 200, is provided in an inner section of the corresponding first space 115, which is in communication with the heating region HA via the support plate 150. Therefore, the hot air that rises in the heating region HA toward the upstream side in the transport direction, is taken into the first space 115 via the intake openings 151, and is caused to flow into the heating chamber 200 again by the first fan 120.

In this manner, it is easy for the hot air to pass between the third partitioning wall 230 and the third support member 70. Additionally, in the heating region HA, while the hot air flows out in a region that faces the first partitioning wall 210, the hot air is taken into the first space 115 from a region that faces the support plate 150. That is, while the gas flows to the downstream side of the heating region HA in the transport direction irrespective of the temperature of the hot air that flows out from the outlets 253 of the first partitioning wall 210, the gas also flowing out from the upstream side in the transport direction, and therefore, it is easy to generate air flow toward the upstream side in the transport direction in the heating region HA.

In addition, the first fan 120 causes gas that passes through the moisture absorption section 140 to flow into the heating chamber 200. Accordingly, in a case in which solvent vapor of the ink is included in the gas that is taken in from the heating region HA via the intake openings 151, the vapor is removed from the corresponding gas. Therefore, even in a case in which the printing apparatus 10 performs printing continuously, a circumstance in which a solvent vapor amount that is included in the gas, which flows out from the heating chamber 200 to the heating region HA, gradually increases, is suppressed.

In addition, among the third support member 70, a site that faces the first partitioning wall 210, in which the outlets 253 are formed penetrating therethrough, forms the zig-zag section 72, in which the contact sections 76 and the refuge sections 77 are lined up in the transport direction F. In this instance, in comparison with the flat surface section 71 and the curved section 73, a contact area between the medium M and the third support member 70 in the zig-zag section 72 is extremely small. Accordingly, even if the medium M is transported in a state in which the corresponding medium M is pushed against the third support member 70 by the hot air that flows out from the heating chamber 200, friction forces (a static friction force and a kinetic friction force) that occur in accordance with the transport of the medium M, are small. That is, an increase in transport resistance in accordance with transport of the medium M, is suppressed.

Additionally, in this respect, in the present embodiment, among regions in which the third support member 70 supports the medium M, a region of the corresponding third support member 70 in which the zig-zag section 72 is provided, is equivalent to a target blowing region BA, which supports the medium M, and in which hot air is blown thereagainst. In other words, among the third support member 70, the target blowing region BA is a region that faces the first partitioning wall 210, in which the outlets 253 are formed penetrating therethrough.

In addition, in the first partitioning wall 210, the outlets 253 are formed into the first intersecting walls 251 and the second intersecting walls 252, which are provided so as to mutually intersect. Therefore, the hot air that flows out from the outlets 253 of the first intersecting walls 251 and the second intersecting walls 252, is mixed together in the heating region HA immediately after flowing out from the heating chamber 200.

Therefore, in the first partitioning wall 210, even in a case in which the temperatures of the hot air that flows out from the outlets 253 of the first intersecting walls 251 and the second intersecting walls 252 differ as a result of the temperatures of adjacent first intersecting walls 251 and the second intersecting walls 252 differing, the hot air that flows out from the respective outlets 253 is mixed together, and therefore, variations in the temperature distribution in the heating region HA are eliminated.

Subsequently the actions when the heating device 100 heats the medium M using thermal radiation will be described.

The temperature of the first partitioning wall 210 and the third partitioning wall 230 rises as a result of the gas that is heated in the heating chamber 200 due to the driving of the first fan 120 and the heating section 130, flowing in. Therefore, infrared rays are emitted from the infrared ray emission surfaces 211 and 231 of the first partitioning wall 210 and the third partitioning wall 230 toward the medium M that is supported by the third support member 70 (the flat surface section 71 and the zig-zag section 72). As a result of this, the medium M that is supported by the third support member 70 is heated by thermal radiation.

In this instance, in the present embodiment, the first partitioning wall 210 and the third partitioning wall 230 are configured by alternately disposing the first intersecting walls 251 and the second intersecting walls 252, which extend in different directions, in the transport direction F. Therefore, the surface areas of the infrared ray emission surfaces 211 and 231 of the first partitioning wall 210 and the third partitioning wall 230 is greater than a projection area obtained by projecting the first partitioning wall 210 and the third partitioning wall 230 toward the third support member 70, and therefore, an infrared ray emission amount with respect to the medium M is greater.

In addition, the first partitioning wall 210 and the third partitioning wall 230 are configured by aluminum (an aluminum alloy), which has a high heat transfer rate among metal materials. Accordingly, the temperatures of the first partitioning wall 210 and the third partitioning wall 230 rise from the beginning when the heating device 100 initiates heating, and the infrared ray emission amount with respect to the medium M is increased at an early stage. In addition, since an alumite process is carried out on the infrared ray emission surfaces 211 and 231 of the first partitioning wall 210 and the third partitioning wall 230, and therefore, the reflectance thereof in the intermediate infrared ray region and the far infrared ray region is greater than or equal to 0.8, the infrared ray emission amount is further increased.

Furthermore, in the abovementioned manner, hot air that flows out from the outlets 253 of the first partitioning wall 210 passes through a region between the third partitioning wall 230 and the third support member 70 (the flat surface section 71). Therefore, it is difficult for the temperature of the third partitioning wall 230 to fall, and therefore, a circumstance in which the infrared ray emission amount from the infrared ray emission surfaces 231 decreases as a result of the temperature of the third partitioning wall 230 falling, is suppressed.

In addition, the third support member 70 that supports the medium M, includes the infrared ray reflective surface 80 that faces the heating device 100. Therefore, among the infrared rays that are emitted from the infrared ray emission surfaces 211 and 231 of the first partitioning wall 210 and the third partitioning wall 230 toward the medium M that is supported by the third support member 70, infrared rays that are transmitted through the medium M, are reflected by the infrared ray reflective surface 80. Therefore, at least a portion of the reflected infrared rays contribute to heating of the medium M that is supported by the third support member 70.

In this manner, according to the present embodiment, the medium M is heated efficiently by heat transfer and thermal radiation, and the solvent component in the ink that is adhered to the medium M is evaporated.

According to the abovementioned embodiment, it is possible to obtain the following effects.

(1) It is possible to heat the medium M that is positioned in the heating region HA using heat transfer by causing hot air to flow out from the heating chamber 200 via the outlets 253, which are opened in the first partitioning wall 210. In addition, it is possible to heat the medium M using thermal radiation by emitting infrared rays from the infrared ray emission surfaces 211 of the first partitioning wall 210 toward the medium M that is positioned in the heating region HA.

In this instance, the emission rate in the intermediate infrared ray region and the far infrared ray region of the infrared ray emission surfaces 211 of the first partitioning wall 210 is high, greater than or equal to 0.8, and therefore, it is possible to efficiently heat the medium M to which the ink is adhered using thermal radiation. In this manner, according to this configuration, it is possible to enhance the heating efficiency of the medium M.

(2) By configuring the first partitioning wall 210 and the third partitioning wall 230 using a material that has excellent reflectance in the intermediate infrared ray region and the far infrared ray region, it is possible to increase the infrared ray emission amount with respect to the medium M from the infrared ray emission surfaces 211 and 231 of the first partitioning wall 210 and the third partitioning wall 230.

(3) According to the present embodiment, since it is possible to efficiently heat the medium M, on which printing is finished, it is even possible to dry the medium M in a case in which the ink that is used in printing is a water-based ink.

(4) Since the first fan 120 causes gas that is taken in from the heating region HA to flow into the heating chamber 200, in comparison with a case of causing gas (for example, external air) from a region that is not the heating region HA to flow into the heating chamber 200, it is difficult for the temperatures of the heating chamber 200 and the heating region HA to fall. In this manner, it is possible to suppress falls in the heating efficiency of the medium M.

(5) Solvent vapor of the ink is generated in the heating region HA as a result of the medium M, on which the ink is ejected, being heated. Therefore, in a case of causing the gas that flows out of the heating region HA to flow into the heating chamber 200 again, it is easy for the solvent vapor amount that is includes in the corresponding gas to gradually increase.

With respect to this point, according to the present embodiment, the solvent vapor of the ink that is included in the gas the is taken into the heating region HA is removed (captured) by the moisture absorption section 140. Accordingly, in the printing apparatus 10, even in a case in which printing is continued, a circumstance in which the solvent vapor amount, which is included in the gas that flows out from the heating chamber 200 toward the heating region HA, gradually increases, is suppressed, and therefore, it is possible to suppress falls in the drying efficiency of the medium M.

(6) The infrared ray emission surfaces 231 of the third partitioning wall 230 face the heating region HA in which hot air flows out from the outlets 253 of the first partitioning wall 210. Therefore, it is difficult for the temperature of the third partitioning wall 230 to fall, and therefore, it is possible to suppress a circumstance in which the infrared ray emission amount from the infrared ray emission surfaces 231 of the third partitioning wall 230 with respect to the medium M decreases.

(7) The support plate 150, in which the intake openings 151 are formed, the third partitioning wall 230, which includes the infrared ray emission surfaces 231, and the first partitioning wall 210, in which the outlets 253 are formed, are disposed lined up in the transport direction F. Therefore, in the heating region HA, it is easier for hot air that flows out from the outlets 253 of the first partitioning wall 210 to pass through a region between the third partitioning wall 230 and the third support member 70. Accordingly, it is difficult for the temperature of the third partitioning wall 230 to fall, and therefore, it is possible to suppress a circumstance in which the infrared ray emission amount from the infrared ray emission surfaces 231 with respect to the medium M decreases.

(8) It is easier for the gas that flows out to the heating region HA via the outlets 253 of the first partitioning wall 210, to rise in the heating region HA in a vertically upward manner (to the upstream side in the transport direction) by an amount by which the gas is heated by the heating section 130. Meanwhile, the heating device 100 of the present embodiment is provided in the order of the support plate 150, the third partitioning wall 230 and the first partitioning wall 210 from the upstream side toward the downstream side in the transport direction. Therefore, the first fan 120 takes in more of the heated gas that flows out from the first partitioning wall 210 to the heating region HA via the outlets 253, and it is possible to cause the corresponding gas to flow into the heating chamber 200. Accordingly, according to this configuration, it is possible to further enhance the heating efficiency of the medium M.

(9) The area of the infrared ray emission surfaces 211 and 231 of the first partitioning wall 210 and the third partitioning wall 230 is greater than a projection area obtained by projecting the infrared ray emission surfaces toward the third support member 70 (the transport path). Therefore, it is possible to increase an infrared ray emission amount with respect to the medium M by an amount by which the area over which it is possible to emit infrared rays with respect to the medium M is greater. In this manner, it is possible to enhance the heating efficiency of the medium M in comparison with a case in which the infrared ray emission surfaces 211 and 231 are flat surfaces.

(10) The first partitioning wall 210 and the third partitioning wall 230 partition the heating chamber 200, and are equivalent to infrared ray emission surfaces that emit infrared ray toward the medium M that is supported by the third support member 70. Therefore, it is possible to set the configuration of the heating device 100 to be more simple than a case in which the partitioning walls that partition the heating chamber 200 and the infrared ray emission surfaces are provided separately.

(11) By setting the penetration directions of the outlets 253 to be different in the first intersecting walls 251 and the second intersecting walls 252, the hot air that flows out from the outlets 253 is mixed together in the heating region HA, and therefore, it is possible to suppress variations in the temperature distribution in the heating region HA.

(12) By setting so that the penetration formation direction of the outlets 253 with respect to the first partitioning wall 210, and the medium M that is supported by the third support member 70 are not orthogonal, a force with which the medium M is pushed against the third support member 70 by the hot air that flows out from the outlets 253 of the first partitioning wall 210, is decreased. Therefore, it is possible to decrease a transport load when transporting the medium M.

(13) By forming the refuge sections 77, which are not capable of coming into contact with the medium M, in the third support member 70 (the zig-zag section 72), which supports the medium M, at an interval in the transport direction F, the contact area between the third support member 70 and the medium M is reduced, and therefore, it is more difficult for heat to be transmitted from the medium M, which is heated, toward the third support member 70. Accordingly, according to this configuration, it is possible to enhance the heating efficiency of the medium.

(14) since the third support member 70 includes the infrared ray reflective surface 80, among the infrared rays that are emitted from the infrared ray emission surfaces 211 and 231 of the first partitioning wall 210 and the third partitioning wall 230 toward the medium M that is supported by the third support member 70, infrared rays that are transmitted through the medium M, are reflected by the infrared ray reflective surface 80. Therefore, at least a portion of the infrared rays that the infrared ray reflective surface 80 reflects are absorbed by the medium M, and therefore, can contribute to heating of the medium M.

(15) The heat amount that is applied to the medium M in order to heat the corresponding medium M is the sum of the heat amount that is applied to the medium M by thermal radiation, and the heat amount that is applied to the medium M by heat transfer. Therefore, according to the present embodiment, since it is possible to reduce the heat amount that is applied to the medium M using heat transfer by improving the heating efficiency of the medium M using thermal radiation, it is possible to reduce the temperature of the hot air that is blown against the medium M. As a result of this, it is possible to make it difficult to thermally deform the medium M when drying a medium M with low thermal resistance such as a resin film with a low melting point.

(16) After at least passing through the heating region HA between the third partitioning wall 230 and the medium M that is supported by the third support member 70, hot air that is blown against the medium M is taken into the first space 115 from the intake openings 151 of the support plate 150. Therefore, it is possible to enhance the heating efficiency of the medium M using heat transfer in comparison with a case in which the hot air that is blown against the medium M is taken into the first space 115 immediately after being blown against the corresponding medium M.

(17) In the printing apparatus 10, which heats the medium M that is supported by the third support member 70 by blowing hot air against the corresponding medium M, in a case in which the blow amount of the gas that is blown against the medium M is high, the transport resistance of the medium M increases as a result of the medium M being pushed against the third support member 70. With respect to this point, according to the present embodiment, the refuge sections 77, which are not capable of coming into contact with the medium M are formed in the third support member 70. Accordingly, even in a case in which the hot air is blown against the medium M that is supported by the third support member 70 with force, it is possible to suppress an increase in the transport resistance of the medium M since there are portions in which the medium M is not pushed against the third support member 70.

Additionally, the abovementioned embodiment may be changed in the following manner.

Among the third support member 70, the heating device 100 heats the medium M that is supported by the zig-zag section 72 as a result of hot air being blown against the corresponding medium M. Therefore, a blowing pressure that the medium M, which is supported by the third support member 70, receives, is greatest in a portion thereof that is supported by the zig-zag section 72, and decreases in portions that are supported by regions that are separated from the zig-zag section 72 (the flat surface section 71 and the curved section 73). In other words, the blowing pressure that the medium M receives, is greatest in the target blowing region BA, and decreases with separation from the target blowing region BA in the transport direction F.

Accordingly, in a case in which the refuge sections 77 and the contact sections 76 are also provided in the flat surface section 71 and the curved section 73, the interval D between the refuge sections 77 in the transport direction F may be made as wide as the distance from the zig-zag section (the target blowing region BA) is far. In other words, the interval between contact sections 76 in the transport direction F may be as narrow as the distance from the zig-zag section 72 is far.

According to this configuration, in the target blowing region BA, since the contact area with the medium M per unit area is small, a pressing force of the medium M with respect to the support section 30 is reduced, and therefore, it is possible to suppress an increase in the transport load. Meanwhile, in regions that are separated from the target blowing region BA, since the contact area with the medium M per unit area is large, it is possible to suitably support the medium M.

In the present embodiment, a configuration in which the heating section 130, which is provided in the inner section of the heating chamber 200, heats gas that the first fan 120, which is provided in the outer section of the heating chamber 200, causes to flow into the heating chamber 200, was used, but other configurations may also be used. For example, a configuration in which the first fan 120 and the heating section 130 are provided in the outer section of the heating chamber 200, and gas, which is heated in advance, is caused to flow into the heating chamber 200, may also be used. In addition, a configuration in which the heating section 130 directly heats the heating chamber 200 (for example, the first partitioning wall 210, the third partitioning wall 230 and the like), may also be used.

As long as the first fan 120 can cause gas to flow into the inner section of the heating chamber 200 from the outer section of the heating chamber 200, the first fan 120 need not be an airblow fan. For example, the first fan 120 may also have an adsorption mechanism such as a pump.

A configuration that is related to the blowing of hot air need not be provided in the heating device 100. In this case, the medium M, on which printing is finished, is heated by thermal radiation from the infrared ray emission surfaces 211 and 231 of the first partitioning wall 210 and the third partitioning wall 230.

The third support member 70 need not be formed so as to run along in a vertically downward manner running along the transport direction F. For example, the third support member 70 may be provided in a flat manner, or may be provided so as to run along in a vertically upward manner running along the transport direction F.

The infrared ray reflective surface 80 of the third support member 70 may be an infrared ray emission surface. In this case, it is desirable that the heat transfer rate of the third support member 70 is high so that it is easy for the corresponding third support member 70 to rise in temperature at an early stage.

As long as the heating device 100 is provided further on the downstream side in the transport direction than the printing section 50, the heating device 100 may be provided in an inner section of a housing in which the printing section 50 is accommodated in the printing apparatus 10.

In the heating device 100, a ratio of the heating amount that is applied to the medium M by heat transfer, and the heating amount that is applied to the medium M by thermal radiation may be changed as appropriate depending on the type of ink or the type of the medium M.

In a case in which a resin is included in the ink such as a case in which a pigment is used as the color material of the ink, it is desirable that the heating device 100 sets the temperature of the heating region HA to a temperature at which the corresponding resin melts.

The opening shapes of the outlets 253 need not be cylindrical. For example, the opening shapes thereof may be elliptical, or may be slit shapes.

The third support member 70 need not be provided. In this case, it is desirable that the medium M, on which a tensile force is acting, is heated in a state in which the corresponding tensile force is caused to act on the medium M, on which printing is finished, in the transport direction F in a manner in which curvature does not occur.

The first partitioning wall 210 and the third partitioning wall 230 need not zig-zag. That is, the first partitioning wall 210 and the third partitioning wall 230 may form flat plate shapes. In addition, the first partitioning wall 210 and the third partitioning wall 230 may include a plurality of uneven sections running toward the inner section and the outer section of the heating chamber 200. The same applies to the zig-zag section 72 of the third support member 70.

The shapes of first partitioning wall 210 and the third partitioning wall 230 may be changed as appropriate. For example, the shapes thereof may be curved plate shapes that curve in a direction in which the capacity of the heating chamber 200 decreases, of may be curved plate shapes that curve in a direction in which the capacity of the heating chamber 200 increases.

The first partitioning wall 210 may be disposed further on the upstream side in the transport direction than the third partitioning wall 230. In addition, the third partitioning wall 230 may be provided on the upstream side in the transport direction of the first partitioning wall 210, and other partitioning walls, which include infrared ray emission surfaces may be provided on the downstream side in the transport direction of the first partitioning wall 210.

The zig-zag state of the first partitioning wall 210 and the third partitioning wall 230 of the heating device 100, and the zig-zag state of the zig-zag section 72 of the third support member 70 may be different.

The first partitioning wall 210 may extend to the upstream side in the transport direction in a manner in which the corresponding first partitioning wall 210 intersects the second partitioning wall 220 without providing the third partitioning wall 230.

The first partitioning wall 210 and the third partitioning wall 230 may be formed by a metal material other than aluminum or an aluminum alloy, and may be formed by a resin material having a heat resistant property. In this case, it is desirable that the infrared ray emission surfaces 211 and 231 of the first partitioning wall 210 and the third partitioning wall 230 are set to be black in order to enhance the reflectance thereof.

The moisture absorption section 140 need not be provided. In this case, it is desirable that the first fan 120 causes external air to flow into the inner section of the heating chamber 200.

As long as the printing apparatus 10 heats the medium M in order to fix ink to the medium M after adhering the corresponding ink to the medium M, the printing apparatus 10 need not be an ink jet printer. For example, the printing apparatus 10 may be a sublimation transfer printer.

The printing apparatus 10 may be a serial printer, may be a line printer, or may be a page printer.

The material of the medium M may be a resin, may be a metal, may be fabric, or may be paper.

Hereinafter, a Modification Example of the ink will be described in detail.

In terms of composition, the ink that is used in the printing apparatus 10 contains a resin, and does not contain glycerin, the boiling point of which is 290° C. at one atmosphere, in a practical sense. If the ink includes glycerin in a practical sense, the drying property of the ink is greatly decreased. As a result of this, on various media, and in particular, ink non-absorbing or ink low-absorbing media, image graduations stand out, and it is not possible to obtain a fixing property of the ink. Furthermore, it is desirable that the ink does not include alkylpolyols (other than the abovementioned glycerin), the boiling points of which are greater than or equal to 280° C. at equivalent to one atmosphere, in a practical sense.

In this instance, in the present specification, the term "does not include in a practical sense" refers to not containing greater than or equal to an amount at which a meaning of addition is sufficiently exhibited. If expressed in a quantitative manner, the ink preferably does not include greater than or equal to 1.0 mass % of glycerin with respect to the total mass of the ink (100 mass %), more preferably does not include greater than or equal to 0.5 mass % thereof, still more preferably does not include greater than or equal to 0.1 mass % thereof, still more preferably does not include greater than or equal to 0.05 mass % thereof, and still more preferably does not include greater than or equal to 0.01 mass % thereof. Further, the ink most preferably does not include greater than or equal to 0.001 mass % of glycerin.

Next, additives (components) that are included or can be included in the abovementioned ink will be described.

1. Color Material

The ink may include a color material. The abovementioned color material is selected from a pigment and a dye.

1-1. Pigment

By using a pigment as the color material, it is possible to improve the light stability of the ink. The pigment can use either an inorganic pigment or an organic pigment. The inorganic pigment is not particularly limited, and for example, examples thereof include carbon black, iron oxide, titanium oxide, and silica oxide.

The organic pigment is not particularly limited, and for example, examples thereof include quinacridone pigments, quinacridonequinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perinone pigments, quinophthalone pigments, anthraquinone pigments, thioindigo pigments, benzimidazolone pigments, isoindolinone pigments, azomethine pigments, and azo pigments. Specific examples of the organic pigment include the following.

Examples of pigments that can be used in cyan ink include C.I. Pigment Blue 1, 2, 3, 15, 15:1, 15:2, 15:3, 15:4, 15:6, 15:34, 16, 18, 22, 60, 65, and 66, and C.I. Vat Blue 4, and 60. Among these, either one of C.I. Pigment Blue 15:3 and 15:4 is preferable.

Examples of pigments that can be used in magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254 and 264, and C.I. Pigment Violet 19, 23, 32, 33, 36, 38, 43, and 50. Among these, one or more selected from a group that is formed from C.I. Pigment Red 122 and 202, and C.I. Pigment Violet 19 is preferable.

Examples of pigments that can be used in yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185 and 213. Among these, one or more selected from a group that is formed from C.I. Pigment Yellow 74, 155 and 213 is preferable.

Additionally, examples of pigments that can be used in colors other than those mentioned above such as green ink and orange ink include pigments that are publicly known from the related art.

The average particle diameter of the pigment is preferably less than or equal to 250 nm in order for it to be possible to suppress blockages in the nozzles, and to further improve discharge stability (the ejection stability). Additionally, the average particle diameter in the present specification is on a volumetric basis. For example, as a measurement method thereof, it is possible to measure using a grain size distribution measuring apparatus that uses a laser diffraction scattering technique as the measurement theory thereof. For example, examples of a grain size distribution measuring apparatus include particle size analyzers that use a dynamic light scattering technique as the measurement theory thereof (for example, a microtrac UPA manufactured by Nikkiso Co., Ltd.).

1-2. Dye

It is possible to use a dye as the color material. The dye is not particularly limited, and it is possible to use an acid dye, a direct dye, a reactive dye, or a basic dye. The contained amount of the color material is preferably 0.4 mass % to 12 mass % with respect to the total mass of the ink (100 mass %), and more preferably greater than or equal to 2 mass % and less than or equal to 5 mass %.

2. Resin

The ink contains a resin. As a result of the ink including a resin, the resin film is formed on the medium, the ink is sufficiently adhered to the medium, and therefore, an effect of mainly making the scuff resistance of the image favorable is exhibited. Therefore, it is preferable that a resin emulsion is a thermoplastic resin. The heat distortion temperature of the resin is preferably greater than or equal to 40° C., and more preferably greater than or equal to 60° C. in terms of obtaining the advantageous effects of it being difficult for blockages to occur in the nozzles and being able to endow scuff resistance of the medium.

In this instance, the "heat distortion temperature" in the present specification is a temperature value that is expressed using the glass transition temperature (Tg) or the minimum film forming temperature (MFT). In other words, the heat distortion temperature being greater than or equal to 40° C." indicates either one of the Tg and the MFT being greater than or equal to 40° C. Additionally, it is desirable that the heat distortion temperature is a temperature value that is expressed using the MFT since it is easier to comprehend the relative merits of redispersibility of the resin for the MFT than the Tg. If the ink has excellent redispersibility, it is difficult for the nozzles to become blocked since the ink does not become fixed thereto.

Specific examples of the abovementioned thermoplastic resin are not particularly limited, but for example, examples thereof include (meth)acrylic polymers such as poly(meth) acrylic acid esters or a copolymer thereof, polyacrylonitrile or a copolymer thereof, polycyanoacrylates, polyacrylamide, and poly(meth)acrylic acid, polyethylene, polypropylene, polybutene, polyisobutylene, and polystyrene, and copolymers thereof, as well as polyolefin-based polymers such as petroleum resins, coumarone-indene resins and terpene resins, vinyl acetates or vinyl alcohol polymers such as polyvinyl acetate or a copolymer thereof, polyvinyl alcohol, polyvinyl acetal, and polyvinyl ether, halogen-containing polymers such as polyvinyl chloride or a copolymer thereof, polyvinylidene chloride, fluoro resins, and fluoro rubbers, nitrogen-containing vinyl polymers such as polyvinyl carbazole, polyvinyl pyrrolidone or a copolymer thereof, polyvinyl pyridine, and polyvinyl imidazole, diene polymers such as polybutadiene or a copolymer thereof, polychloroprene, and polyisoprene (butyl rubber), and other ring-opening polymerization type resins, condensation polymerization type resins, and natural polymer resins.

The contained amount of the resin is preferably 1 mass % to 30 mass % with respect to the total mass of the ink (100 mass %), and more preferably 1 mass % to 5 mass %. In a case in which the contained amount is in these ranges, it is possible to configure an ink with more superior glossiness and scuff resistance of a final coating image that is formed. In addition, for example, examples of resins that may be contained in the abovementioned ink include resin dispersants, resin emulsions, and waxes.

2-1. Resin Emulsion

The ink may include a resin emulsion. The resin emulsion preferably forms a resin film with a wax (an emulsion) when the medium is heated, and as a result, an effect of making the scuff resistance of an image favorable by sufficiently fixing the ink to the medium is exhibited. In a case of printing on a medium with an ink that contains a resin emulsion, as a result of the abovementioned effect, an ink with particularly excellent scuff resistance on ink non-absorbing or ink low-absorbing media, is obtained.

In addition, a resin emulsion that functions as a binder is contained in an emulsion state in the ink. As a result of containing a resin emulsion that functions as a binder is contained in an emulsion state, it is easy to adjust the viscosity of the ink to a range that is appropriate in an ink jet recording method, and it is possible to enhance the preservation stability and discharge stability of the ink.

The resin emulsion is not particularly limited, and for example, examples thereof include homopolymers or copolymers of (meth)acrylic acids, (meth)acrylic acid esters, acrylonitriles, cyanoacrylates, acrylamides, olefins, styrenes, vinyl acetates, vinyl chlorides, vinyl alcohols, vinyl ethers, vinyl pyrrolidones, vinyl pyridines, vinyl carbazoles, vinyl imidazoles, and vinylidene chlorides, or fluoro resins, and natural resins. Among these, either one of methacrylic resins and styrene-methacrylic acid copolymer resins are preferable, acrylic resins and styrene-acrylic acid copolymer resins are more preferable, and styrene-acrylic acid copolymer resins are still more preferable. Additionally, the abovementioned copolymer may take any form of a random copolymer, a block copolymer, an alternating copolymer, and a graft copolymer.

The average particle diameter of the resin emulsion is preferably in a range of 5 nm to 400 nm, and more preferably in a range of 20 nm to 300 nm in terms of making the preservation stability and the discharge stability of the ink more favorable. The contained amount of the resin emulsion in the resin is preferably in a range of 0.5 mass % to 7 mass % with respect to the total mass of the ink (100 mass %). If the contained amount is in the abovementioned range, since it is possible to reduce the solid content concentration, it is possible to make the discharge stability more favorable.

2-2. Wax

The ink may include a wax. As a result of the ink including a wax, an ink that has a more superior ink fixing property on ink non-absorbing or ink low-absorbing media is obtained. It is preferable that the wax is an emulsion type wax. The abovementioned wax is not particularly limited, but, for example, examples thereof include polyethylene waxes, paraffin waxes, and polyolefin waxes, and among these, polyethylene waxes, which will be described later, are preferable. Additionally, in the present specification, the term "wax" mainly refers to a substance in which solid wax particles are dispersed in water using a surfactant, which will be described later.

As a result of the abovementioned ink including a polyethylene wax, it is possible to obtain excellent scuff resistance. The average particle diameter of the polyethylene wax is preferably in a range of 5 nm to 400 nm, and more preferably in a range of 50 nm to 200 nm in terms of making the preservation stability and the discharge stability of the ink more favorable.

The contained amount (the solid content conversion) of the polyethylene wax is preferably 0.1 mass % to 3 mass % with respect to the total mass of the ink (100 mass %), more preferably 0.3 mass % to 3 mass %, and still more preferably 0.3 mass % to 1.5 mass %. If the contained amount is in these ranges, it is also possible to harden or fix the ink favorably on ink non-absorbing or ink low-absorbing media, and it is possible to make the preservation stability and the discharge stability of the ink more superior.

3. Surfactant

The ink may include a surfactant. The surfactant is not particularly limited, but for example, examples thereof include a nonionic surfactant. The nonionic surfactant has an action of uniformly spreading the ink on a medium. Therefore, in a case of performing printing using an ink that includes a nonionic surfactant, high-resolution images with practically no smearing, are obtained. Such a nonionic surfactant is not particularly limited, but for example, examples thereof include silicon-based, polyoxyethylene alkyl ether-based, polyoxypropylene alkyl ether-based, polycyclic phenyl ether-based, sorbitan derivatives, and fluorine-based surfactants, and among these, a silicon-based surfactant is preferable.

The contained amount of the surfactant is preferably in a range of greater than or equal to 0.1 mass % and less than or equal to 3 mass % with respect to the total mass of the ink (100 mass %) in terms of making the preservation stability and the discharge stability of the ink more favorable.

4. Organic Solvent

The ink may include a publicly-known volatile organic solvent. However, in the abovementioned manner, it is desirable that the ink does not include glycerin (the boiling point of which is 290° C. at one atmosphere), which is a type of organic solvent, in a practical sense, and, in addition, that the ink does not include alkylpolyols (other than the abovementioned glycerin), the boiling points of which are greater than or equal to 280° C. at one atmosphere, in a practical sense.

5. Non-Proton Type Polar Solvent

The ink may include a non-proton type polar solvent. As a result of a non-proton type polar solvent being contained in the ink, since the abovementioned resin particles, which are included in the ink, are dissolved, it is possible to effectively suppress blockage of the nozzles when printing. In addition, since a non-proton type polar solvent has a property of dissolving a medium such as vinyl chloride, the adhesiveness of an image is improved.

The non-proton type polar solvent is not particularly limited, but for example, examples thereof include one or more selected from pyrrolidones, lactones, sulfoxides, imidazolidinones, sulfolanes, urea derivatives, dialkyl amides, cyclic ethers, and amide ethers. Examples of pyrrolidones include 2-pyrrolidone, N-methyl-2-pyrrolidone, and N-ethyl-2-pyrrolidone, examples of lactones include γ-butyrolactone, γ-valerolactone, and ε-caprolactone and examples of sulfoxides include dimethyl sulfoxide, and tetramethylene sulfoxide.

Examples of imidazolidinones include 1,3-dimethyl-2-imidazolidinone, examples of sulfolanes include sulfolane and dimethylsulfolane and examples of urea derivatives include dimethyl urea and 1,1,3,3-tetramethylurea. Examples of dialkyl amides include dimethyl formamide and dimethyl acetamide, and examples of cyclic ethers include 1,4-dioxane and tetrahydrofuran.

Among these, pyrrolidones, lactones, sulfoxides and amide ethers are particularly preferable, and 2-pyrrolidone is most preferable from a viewpoint of the abovementioned effects. The contained amount of the non-proton type polar solvent is preferably in a range of 3 mass % to 30 mass % with respect to the total mass of the ink (100 mass %), and more preferably in a range of 8 mass % to 20 mass %.

6. Other Components

In addition to the abovementioned components, the ink may further include antifungal agents, rust inhibitors, chelating agents and the like.

It is desirable that a second liquid is a substrate that promotes curing of the thermoplastic resin that in included in the abovementioned ink. As an example, a case in which an acrylic polymer or a polystyrene is used as the resin that is included in the ink, it is desirable that epichlorohydrin is used as the second liquid.

The entire disclosure of Japanese Patent Application No. 2015-034403, filed Feb. 24, 2015 is expressly incorporated by reference herein.

What is claimed is:

1. A printing apparatus comprising:

a printing section that performs printing by adhering an ink to a medium;

a transport section that transports the medium along a transport path of the medium; and a heating device that heats the medium, on which printing is finished, wherein a region between the transport path and the heating device is set as a heating region, wherein the heating device includes an infrared ray emission section which has an infrared ray emission surface that faces the transport path via the heating region, and a heating section which heats the infrared ray emission section, wherein at least a portion of the infrared emission section includes at least a first partitioning wall formed in a zig-zag shape, the first partitioning wall including flow outlets for providing hot air heated by the heating section to the heating region, the first partitioning wall comprising intersecting walls meeting at an apex with the flow path outlets spaced from the apex, wherein the first partitioning wall includes an aluminum alloy and an oxide layer formed on a surface of the aluminum alloy, wherein the aluminum alloy contains Aluminum (Al) and 0.3 wt % to 4.3 wt % of manganese (Mn), wherein the Mn and Al intermetallic compound is precipitated, wherein the heating device includes a portion configured to cool the medium at a position downstream of the heating region, and an area of the infrared ray emission surface is greater than a projection area obtained by projecting the infrared ray emission surface toward the transport path.

2. The printing apparatus according to claim 1, wherein, the heating device includes a heating chamber, at least a part of which is partitioned by the first partitioning wall and a second partitioning wall, through which an inlet is formed penetrating therethrough, and a gas inflow section that causes a gas to flow into the heating chamber via the inlet, and the heating section heats the heating chamber.

3. The printing apparatus according to claim 2, further comprising:

a support member that supports the medium, configures at least a part of the transport path, and is provided to face the heating device via the heating region, wherein the first partitioning wall includes the intersecting walls that extend in a direction that intersects the medium supported on the support member, and wherein the outlet is formed penetrating through the intersecting wall in a thickness direction thereof.

4. The printing apparatus according to claim 2, wherein the gas inflow section causes a gas that is taken in from the heating region to flow into the heating chamber.

* * * * *